US010331068B2

(12) United States Patent
Itagaki

(10) Patent No.: US 10,331,068 B2
(45) Date of Patent: Jun. 25, 2019

(54) IMAGE FORMING APPARATUS PERFORMING DENSITY ADJUSTMENT CONTROL

(71) Applicant: CANON KABUSHIKI KAISHA, Tokyo (JP)

(72) Inventor: Tomohisa Itagaki, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/990,345

(22) Filed: May 25, 2018

(65) Prior Publication Data

US 2018/0348684 A1 Dec. 6, 2018

(30) Foreign Application Priority Data

Jun. 1, 2017 (JP) ..... 2017-109253

(51) Int. Cl.
*G03G 15/16* (2006.01)
*G03G 15/00* (2006.01)

(52) U.S. Cl.
CPC ..... *G03G 15/5058* (2013.01); *G03G 15/1605* (2013.01); *G03G 2215/00059* (2013.01)

(58) Field of Classification Search
CPC ..... G03G 15/1605; G03G 15/5058; G03G 2215/00059
See application file for complete search history.

(56) References Cited

U.S. PATENT DOCUMENTS 5,566,372 A 10/1996 Ikeda
8,155,542 B2 * 4/2012 Itou ..... H04N 1/506 399/43
2017/0031289 A1 * 2/2017 Itagaki ..... G03G 15/5058

FOREIGN PATENT DOCUMENTS

JP 2015-210426 A 11/2015
JP 2017-044978 A 3/2017

* cited by examiner

*Primary Examiner* — Hoang X Ngo
(74) *Attorney, Agent, or Firm* — Canon U.S.A. Inc., IP Division

(57) ABSTRACT

In an image forming apparatus, when images are formed on a plurality of sheets, a controller controls an image forming unit to form a measurement image between an image which is to be transferred to a first sheet of the plurality of sheets and an image which is to be transferred to a second sheet of the plurality of sheets, controls a sensor to measure the measurement image, determines a feedback condition based on a length of each of the plurality of sheets in a conveyance direction, and controls an image forming condition based on a result of measurement performed by the sensor and the determined feedback condition, wherein the image which is to be transferred to the second sheet of the plurality of sheets is adjacent to the image which is to be transferred to the first sheet of the plurality of sheets on an image bearing member.

12 Claims, 9 Drawing Sheets

190 Dot

230 Dot

COPIER

ERROR DIFFUSION

FIG.8

| | SCREEN | MEASUREMENT IMAGE SIGNAL VALUE |
|---|---|---|
| L-TH SHEET | 190 Dot | 20% |
| (L+1)-TH SHEET | | 40% |
| (L+2)-TH SHEET | | 60% |
| (L+3)-TH SHEET | | 80% |
| (L+4)-TH SHEET | | 100% |
| (L+5)-TH SHEET | 230 Dot | 20% |
| (L+6)-TH SHEET | | 40% |
| (L+7)-TH SHEET | | 60% |
| (L+8)-TH SHEET | | 80% |
| (L+9)-TH SHEET | | 100% |
| (L+10)-TH SHEET | COPIER | 40% |

IMAGE FORMING APPARATUS PERFORMING DENSITY ADJUSTMENT CONTROL

BACKGROUND OF THE INVENTION

Field of the Invention

Aspects of the present disclosure generally relate to density adjustment control of an image which is formed by an image forming apparatus.

Description of the Related Art

An electrophotographic-type image forming apparatus includes a charging device, which charges a photosensitive member, an exposure device, which exposes the photosensitive member to laser light to form an electrostatic latent image on the photosensitive member, and a development device, which develops the electrostatic latent image. A visible image is formed by the development device developing the electrostatic latent image with use of a developer. The image forming apparatus further includes a transfer device and a fixing device. The transfer device transfers an image formed on the photosensitive member to a sheet. Then, the fixing device fixes the image on the sheet to the sheet. This enables an image to be formed on the sheet.

An image forming apparatus discussed in U.S. Pat. No. 5,566,372 forms a measurement image on an image bearing member for the purpose of adjusting the density of an image to a target density, and generates an image forming condition based on a result of measurement of the measurement image performed by a measurement unit. When a power switch has been turned on, the image forming apparatus discussed in U.S. Pat. No. 5,566,372 forms a measurement image on an image bearing member and generates an image forming condition based on a result of measurement performed by the measurement unit.

Moreover, when the image forming apparatus is continuously forming a plurality of images, the density of each image may vary. Therefore, at any time in the process of continuously forming a plurality of images, the image forming apparatus needs to form a measurement image and adjust the image forming condition based on a result of measurement of the measurement image performed by the measurement unit.

On the other hand, the image forming apparatus is also able to perform image formation on a sheet longer than a predetermined length (a long sheet). In a case where the image forming apparatus continuously forms images on a plurality of long sheets, a time interval at which to adjust the image forming condition would become longer. Therefore, when such a conventional image forming apparatus continuously forms images on a plurality of long sheets, the density of each image may vary.

SUMMARY OF THE INVENTION

According to an aspect of the present disclosure, an image forming apparatus includes a conveyance roller configured to convey a sheet, an image forming unit configured to form an image on an image bearing member, a transfer portion at which the image is transferred from the image bearing member to the sheet, a sensor configured to measure a measurement image formed on the image bearing member, and a controller configured to, in a case where the image forming unit forms images on a plurality of first sheets, control the image forming unit to form a first measurement image between an image which is to be transferred to a first sheet of the plurality of first sheets and an image which is to be transferred to a different first sheet of the plurality of first sheets, control the sensor to measure the first measurement image, and control an image forming condition based on a result of measurement of the first measurement image performed by the sensor and a first feedback condition, and, in a case where the image forming unit forms images on a plurality of second sheets, control the image forming unit to form a second measurement image between an image which is to be transferred to a second sheet of the plurality of second sheets and an image which is to be transferred to a different second sheet of the plurality of second sheets, control the sensor to measure the second measurement image, and control the image forming condition based on a result of measurement of the second measurement image performed by the sensor and a second feedback condition which is different from the first feedback condition, wherein a length of the second sheet in a conveyance direction is larger than a length of the first sheet in the conveyance direction.

Further features of the present disclosure will become apparent from the following description of exemplary embodiments with reference to the attached drawings.

BRIEF DESCRIPTION OF THE DRAWINGS

FIG. 8 illustrates a table for a forming condition of a measurement image and scheduling.

DESCRIPTION OF THE EMBODIMENTS

<Configuration of Image Forming Apparatus>

Figure 1:
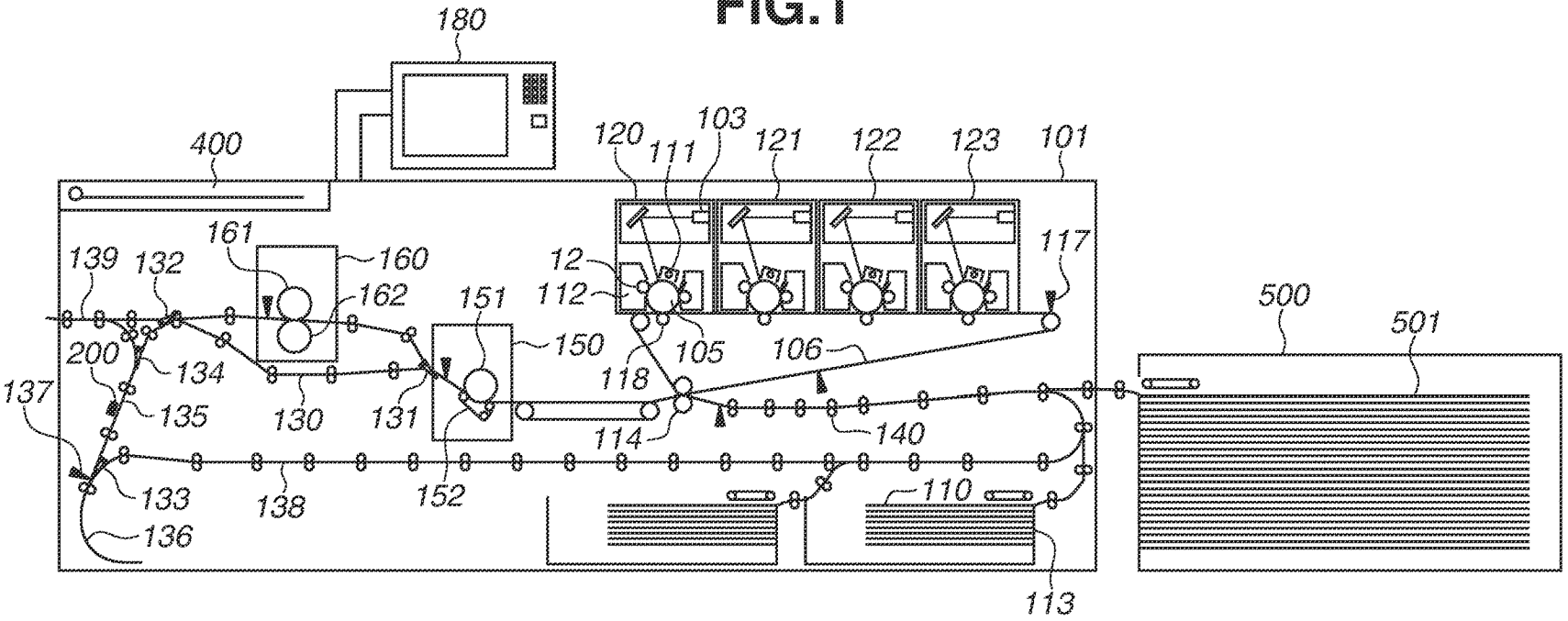
FIG. 1 is a schematic sectional view of an image forming apparatus.

An image forming apparatus is described with reference to FIG. 1. The image forming apparatus 100 includes a printing unit 101, a reader unit 400, and an operation unit 180. The printing unit 101 includes four stations 120, 121, 122, and 123, which form images for respective colors. The station 120 forms a yellow image, the station 121 forms a magenta image, the station 122 forms a cyan image, and the station 123 forms a black image.

Since each station has the same configuration, hereinafter, a configuration of the station 120, which forms a yellow image, is described. A photosensitive drum 105 is a photosensitive member having a photosensitive layer on the surface thereof. A charging device 111 receives a charging voltage supplied from a high-voltage power source (not illustrated). The charging device 111 charges the surface of the photosensitive drum 105 based on the charging voltage. The photosensitive drum 105 being scanned with laser light emitted from an exposure device 103 controlled based on image data causes an electrostatic latent image to be formed on the photosensitive drum 105. The intensity of laser light emitted from the exposure device 103 (hereinafter referred to as "LPW") is controlled based on, for example, a driving current. A development device 112 includes a container portion, in which a developer is contained, and a developing sleeve 12, which rotates while bearing the developer contained in the container portion. Furthermore, the developer is, for example, a two-component developer containing toner and magnetic carrier. The development device 112 develops an electrostatic latent image with use of the developer contained in the container portion. This causes an image to be borne on the photosensitive drum 105. The photosensitive drum 105 functions as an image bearing member which bears an image formed by the printing unit 101. Furthermore, the amount of toner to be supplied from the developing sleeve 12 to the photosensitive drum 105 is adjusted based on a development voltage supplied to the developing sleeve 12.

A primary transfer roller 118 receives a transfer voltage applied from a high-voltage power source (not illustrated). This causes a potential difference between the photosensitive drum 105 and the primary transfer roller 118. Accordingly, an image on the photosensitive drum 105 is transferred to an intermediate transfer belt 106. Images of respective colors formed by the respective stations 120, 121, 122, and 123 are transferred to the intermediate transfer belt 106 in a superimposed manner, so that a full-color image is borne on the intermediate transfer belt 106. The intermediate transfer belt 106 functions as an image bearing member which bears an image. Alternatively, the intermediate transfer belt 106 functions as a transfer member to which an image is transferred. An image borne by the intermediate transfer belt 106 is conveyed to a secondary transfer roller 114 according to the intermediate transfer belt 106 rotating. The configuration of the image bearing member (or the transfer member) is not limited to a belt. The configuration of the image bearing member (or the transfer member) can be, for example, an intermediate transfer drum of the drum shape which rotates in a predetermined direction. The surface of the intermediate transfer drum has an elastic layer containing carbon black formed thereon.

Sensors 117, each of which measures reflected light from a measurement image, are located in the vicinity of the intermediate transfer belt 106. Four sensors 117 are arranged side by side in a direction perpendicular to the conveyance direction of the intermediate transfer belt 106. The sensors 117 detect measurement images formed at respective positions different in the direction perpendicular to the conveyance direction. The image forming apparatus 100 adjusts an image forming condition based on the intensity of reflected light from the measurement images measured by the sensors 117. Here, the image forming condition refers to, for example, a charging voltage, an LPW, a development voltage, and a transfer voltage. The image forming condition to be adjusted can also be any one of the four parameters, or can also be some of the four parameters.

The image forming apparatus 100 includes a plurality of sheet containers 113 and a sheet container 500. Each of the sheet containers 113 in the present exemplary embodiment is able to contain therein a sheet 110 the length of which in the longitudinal direction thereof is less than 19.2 inches (487.68 mm). Moreover, the sheet container 500 in the present exemplary embodiment is able to contain therein a sheet 501 the length of which in the longitudinal direction thereof is equal to or greater than 19.2 inches (487.68 mm) and less than 35 inches (889 mm). In the following direction, the sheet 501 is referred to as a "long sheet 501".

In a case where the image forming apparatus 100 forms an image on the sheet 110, the sheet 110 is fed from the sheet container 113. Then, conveyance rollers 140 convey the sheet 110 toward a secondary transfer portion in such a manner that the sheet 110 coincides in timing with an image borne on the intermediate transfer belt 106. The secondary transfer portion is a nip portion between the secondary transfer roller 114 and the intermediate transfer belt 106. A transfer voltage (a transfer voltage different from the transfer voltage applied to the primary transfer roller 118) is applied to the secondary transfer roller 114. This causes the secondary transfer roller 114 to transfer the image borne on the intermediate transfer belt 106 to the sheet 110 conveyed to the secondary transfer portion. Then, the sheet 110 having the image transferred thereto is conveyed to fixing devices 150 and 160.

Moreover, in a case where the image forming apparatus 100 forms an image on the sheet 501, a long sheet 501 contained in the sheet container 500 is fed. Then, the conveyance rollers 140 convey the long sheet 501 toward the secondary transfer roller 114 in such a manner that the long sheet 501 coincides in timing with an image borne on the intermediate transfer belt 106. Image forming processing which the image forming apparatus 100 performs to form an image on the long sheet 501 is similar to image forming processing which the image forming apparatus 100 performs to form an image on the sheet 110, and, therefore, hereinafter, the image forming processing which the image forming apparatus 100 performs to form an image on the sheet 110 is described.

The fixing devices 150 and 160 fix, to the sheet 110, an image transferred to the sheet 110 by heating and pressing the image. The fixing device 150 includes a fixing roller 151, which has a heater that heats the sheet 110, and a pressure belt 152, which brings the sheet 110 into press contact with the fixing roller 151. The fixing device 160 is located more downstream in the conveyance direction of the sheet 110 than the fixing device 150. The fixing device 160 gives a gloss (sheen) to an image formed on the sheet 110, which has passed through the fixing device 150. The fixing device 160 includes a fixing roller 161, which has a heater that heats the sheet 110, and a pressure roller 162.

In the case of fixing an image to the sheet 110 in a mode for giving a gloss or in the case of fixing an image to a sheet 110 requiring a large amount of heat for fixing, such as a cardboard, the sheet 110, which has passed through the fixing device 150, is conveyed to the fixing device 160. In the case of fixing an image to a sheet 110 such as plain paper or thin paper, the sheet 110, which has passed through the fixing device 150, is conveyed along a conveyance path 130, which takes a detour around the fixing device 160. Furthermore, the angle of a diverter (flapper) 131 is controlled so as to control whether to convey the sheet 110 to the fixing device 160 or to convey the sheet 110 around the fixing device 160.

A diverter (flapper) 132 is a guidance member which switches whether to guide the sheet 110 to a conveyance path 135 or to guide the sheet 110 to a conveyance path 139, which leads to the exterior. The sheet 110, which has been conveyed along the conveyance path 135, is conveyed to a reversing portion 136. When a reversal sensor 137, which is provided on the conveyance path 135, detects the trailing edge of the sheet 110, the conveyance direction of the sheet 110 is reversed.

A diverter (flapper) 133 is a guidance member which switches whether to guide the sheet 110 to a conveyance path 138, which is used for two-sided image formation, or to guide the sheet 110 to the conveyance path 135. In a case where a face-down sheet discharge mode is performed, the sheet 110 is re-conveyed to the conveyance path 135 and is then discharged from the image forming apparatus 100.

On the other hand, in a case where a two-sided printing mode is performed, the sheet 110 is re-conveyed to the transfer roller 114 along the conveyance path 138. In the case of the two-sided printing mode, after an image is formed on the first surface of the sheet 110, the sheet 110 is inverted at the reversing portion 136 and is then conveyed to the transfer roller 114 along the conveyance path 138, so that an image is formed on the second surface of the sheet 110.

A diverter (flapper) 134 is a guidance member which guides the sheet 110 to the conveyance path 139, which is used to discharge the sheet 110 from the image forming apparatus 100. In a case where the sheet 110 is discharged face-down, the diverter 134 guides the sheet 110, which has been inverted at the reversing portion 136, to the conveyance path 139 for sheet discharge. The sheet 110, which has been conveyed along the conveyance path 139 for sheet discharge, is discharged to the exterior of the image forming apparatus 100.

Color sensors 200, each of which measures reflected light from a measurement image on the sheet 110, are located on the conveyance path 135. Four color sensors 200 are arranged side by side in a direction perpendicular to the conveyance direction of the sheet 110. Each color sensor 200 measures a measurement image on the sheet 110. The image forming apparatus 100 adjusts an image forming condition including, for example, a charging voltage, an LPW, a development voltage, a transfer voltage which is applied to the primary transfer roller 118, a transfer voltage which is applied to the secondary transfer roller 114, and target temperatures of the fixing devices 150 and 160 based on a result of measurement performed by the color sensors 200.

The operation unit 180 includes a liquid crystal display, which serves as a display unit, and a key input unit. The operation unit 180 is an interface used for the user to input the number of printed sheets for an image and a printing mode. The user is allowed to use the operation unit 180 to select between a one-sided printing mode and a two-sided printing mode, to perform a face-down sheet discharge mode, or to give an instruction for image formation with a long sheet.

Figure 3:
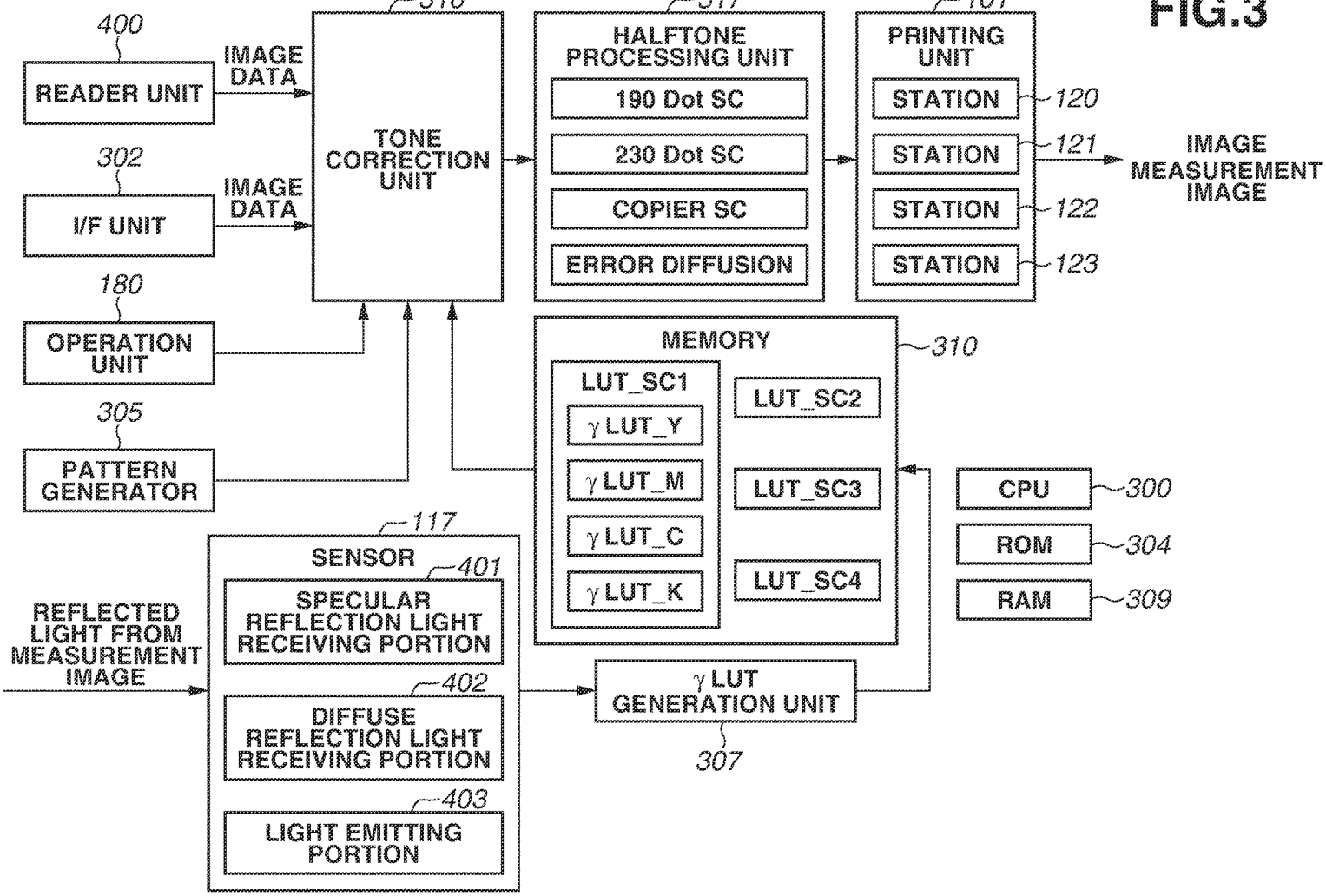
FIG. 3 is a control block diagram of the image forming apparatus.

A reader unit 400, which includes a unit including a light source, an optical system, and a charge-coupled device (CCD) sensor and a platen, reads the image of an original placed on the platen. When an original is placed on the platen and a reading start button of the operation unit 180 is pressed by the user, the reader unit 400 performs a reading operation. When performing the reading operation, the reader unit 400 radiates light from the light source to the original and then causes the CCD sensor to acquire reflected light from the original. The CCD sensor outputs luminance data which represents a result of reading of the original. The reader unit 400 converts the luminance data into density data (image data) with use of a luminance-density conversion table and transfers the density data to a tone correction unit 316 (FIG. 3) of the image forming apparatus 100. Furthermore, the luminance-density conversion table is previously stored in a read-only memory (ROM) 304 (FIG. 3).

<Configuration of Sensor>

Figure 2:
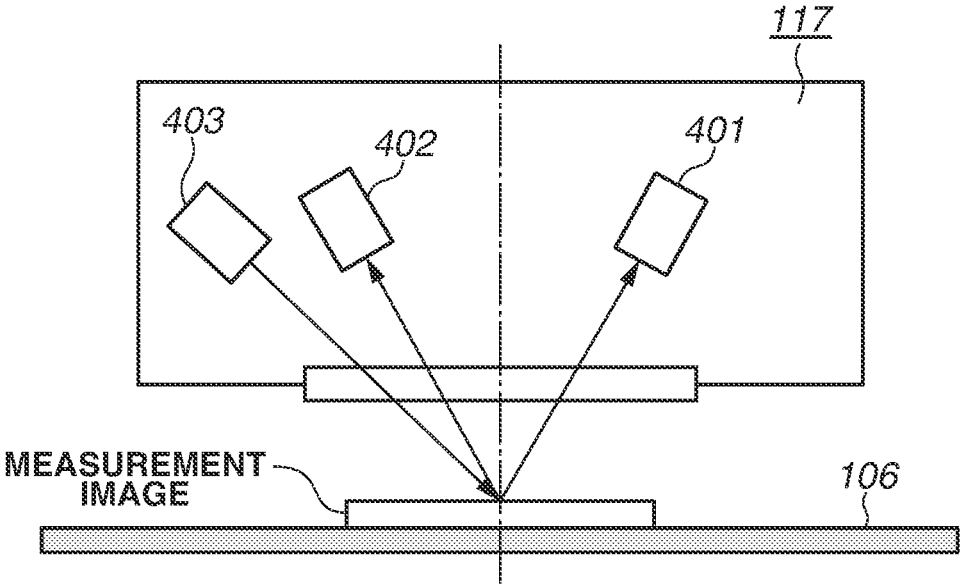
FIG. 2 is an essential-portion sectional view of a sensor which measures a measurement image.

A configuration of the sensor 117 provided in the image forming apparatus 100 is described with reference to FIG. 2. The sensor 117 includes a specular reflection light receiving portion 401, a diffuse reflection light receiving portion 402, and a light emitting portion 403. Furthermore, the sensor 117 can be configured to further include an optical element such as a lens.

The light emitting portion 403 is a light emitting element which radiates light to a measurement image formed on the intermediate transfer belt 106. The wavelength of light to be radiated from the light emitting portion 403 is set to, for example, 800 nanometer (nm) to 850 nm in view of the spectral reflectivity of a developer. Light from the light emitting portion 403 is radiated in a direction that makes an angle of 45 degrees with a direction perpendicular to the surface of the intermediate transfer belt 106.

The specular reflection light receiving portion 401 is provided on an imaginary line that makes an angle of 45 degrees with a direction perpendicular to the surface of the intermediate transfer belt 106. For example, the light emitting portion 403 and the specular reflection light receiving portion 401 are located at positions symmetrical with respect to a surface perpendicular to the surface of the intermediate transfer belt 106. The specular reflection light receiving portion 401 receives specular reflection light from a measurement image formed on the intermediate transfer belt 106. The specular reflection light receiving portion 401 outputs a sensor output value (a voltage value) corresponding to the intensity of reflected light from the measurement image.

The diffuse reflection light receiving portion 402 is provided at a position at which no specular reflection light from the intermediate transfer belt 106 is received. The diffuse reflection light receiving portion 402 is provided on an imaginary line that makes angle of, for example, 20 degrees with a direction perpendicular to the surface of the intermediate transfer belt 106. The diffuse reflection light receiving portion 402 receives diffuse reflection light from the measurement image on the intermediate transfer belt 106. The diffuse reflection light receiving portion 402 outputs a sensor output value (a voltage value) corresponding to the intensity of reflected light from the measurement image.

The image forming apparatus 100 measures the density of the measurement image based on the sensor output value output from the specular reflection light receiving portion 401 and the sensor output value output from the diffuse reflection light receiving portion 402. For example, the image forming apparatus 100 determines the density of the measurement image by performing calculation based on the sensor output value output from the specular reflection light receiving portion 401 and the sensor output value output from the diffuse reflection light receiving portion 402. Alternatively, the image forming apparatus 100 determines the density of the measurement image by referring to a table representing a correspondence relationship between a combination of the sensor output value output from the specular reflection light receiving portion 401 and the sensor output value output from the diffuse reflection light receiving portion 402 and a density.

<Configuration of Controller>

A control block diagram of the image forming apparatus 100 is described with reference to FIG. 3. A central processing unit (CPU) 300 is a control circuit (controller) which controls each unit of the image forming apparatus 100. A control program which is executed by the CPU 300 and is required to perform, for example, various processing operations described in a flowchart to be described below is stored in the ROM 304. A random access memory (RAM) 309 is a system work memory used for the CPU 300 to operate.

The printing unit 101 corresponds to the stations 120, 121, 122, and 123, the primary transfer roller 118, the intermediate transfer belt 106, the secondary transfer roller 114, the fixing device 150, and the fixing device 160. Since the operation unit 180 and the reader unit 400 have already been described, the description thereof is omitted here. Moreover, an interface (I/F) unit 302 is an interface to which image data transferred from a personal computer (PC) as an external apparatus is input.

The tone correction unit 316 performs various image processing operations on input image data to perform conversion of the image data. The density of an image which is formed by the printing unit 101 may not become an intended density. Therefore, the tone correction unit 316 corrects an input value of image data (an image signal value) in such a manner that the density of an image which is formed by the printing unit 101 becomes an intended density. The tone correction unit 316 performs conversion of image data based on a tone correction table (γ look-up table (LUT)) stored in a memory 310. Furthermore, the tone correction table is stored for each screen, which is described below, and for each color in the memory 310. The tone correction table (γ LUT) is equivalent to a conversion condition for conversion of image data. Alternatively, the tone correction table (γ LUT) is an example of an image forming condition for adjusting the density of an output image which is formed by the image forming apparatus 100. Furthermore, the tone correction unit 316 can be implemented by an integrated circuit such as an application specific integrated circuit (ASIC) or can be implemented by the CPU 300 performing conversion of image data based on a previously-stored program. The tone correction unit 316 is generally referred to as an "image processing unit".

A halftone processing unit 317 performs screening suited to the type of an image on image data subjected to conversion by the tone correction unit 316. The halftone processing unit 317 performs conversion of image data based on, for example, a 190 Dot screen in such a manner that a photographic image or graphic image becomes an image excellent in tone characteristics. The halftone processing unit 317 performs conversion of image data based on, for example, a 230 Dot screen in such a manner that a character image is printed in a sharp manner. The halftone processing unit 317 performs conversion of image data based on, for example, an error diffusion method in such a manner that a high-resolution image becomes an image with moire prevented or reduced.

In a case where input image data is image data for printing generated with use of a page-description language, the halftone processing unit 317 performs conversion of image data based on the 190 Dot screen, the 230 Dot screen, and the error diffusion method. On the other hand, in a case where an image other than a character image of an original read by the reader unit 400 is printed, the halftone processing unit 317 performs conversion of image data transferred from the reader unit 400 based on a copier screen.

Figure 4A:
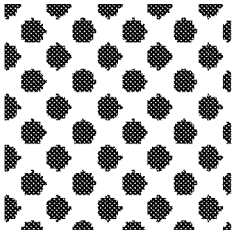
FIGS. 4A, 4B, 4C, and 4D are explanatory diagrams of screens which are formed by the image forming apparatus.
Figure 4B:
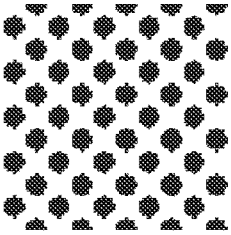
Figure 4C:
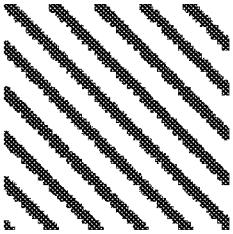
Figure 4D:
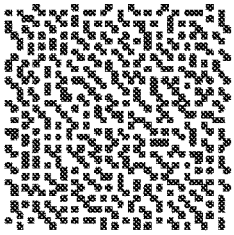

Moreover, FIG. 4A is an enlarged view of an image (halftone) processed based on the 190 Dot screen. Similarly, FIG. 4B is an enlarged view of an image (halftone) processed based on the 230 Dot screen, FIG. 4C is an enlarged view of an image (halftone) processed based on the copier screen, and FIG. 4D is an enlarged view of an image (halftone) processed based on the error diffusion method. Furthermore, the above-mentioned screens are mere examples and the present exemplary embodiment is not limited to these specific screens.

Moreover, a tone correction table LUT_SC1 stored in the memory 310 is a conversion condition for performing conversion of image data about a graphic image. Similarly, a tone correction table LUT_SC2 is a conversion condition for performing conversion of image data about a character image. A tone correction table LUT_SC3 is a conversion condition for performing conversion of image data input from the reader unit 400. A tone correction table LUT_SC4 is a conversion condition for performing conversion of image data about a photographic image.

The image data subjected to screening by the halftone processing unit 317 is input to the printing unit 101. The printing unit 101 forms, on the sheet 110, an image that is based on the input image data.

A pattern generator 305 outputs measurement image data. The printing unit 101 forms a measurement image in a region between an image borne on the intermediate transfer belt 106 and an image adjacent to the first-mentioned image based on the measurement image data output from the pattern generator 305. The CPU 300 acquires sensor output values at timing at which the measurement image on the intermediate transfer belt 106 passes through the measurement position of the sensors 117. Then, the CPU 300 can determine the density of the measurement image based on the sensor outputs. Furthermore, the CPU 300 can determine the amount of adhesion of a developer based on the sensor outputs.

A γ LUT generation unit 307 generates a tone correction table (γ LUT) based on the density of the measurement image measured by the CPU 300 and the sensors 117 and a previously-determined target density. Furthermore, the measurement image is formed for each color and for each screen. The γ LUT generation unit 307 generates a tone correction table corresponding to the measurement image based on a result obtained by measuring each measurement image.

<Density Adjustment Control>

Next, density adjustment control is described. The image forming apparatus 100 is able to perform two types of density adjustment control, i.e., a first calibration and a second calibration.

The first calibration is control in which the image forming apparatus 100 causes the printing unit 101 to form a pattern image on the sheet 110 and generates an image forming condition based on the density of the pattern image measured by the color sensors 200 or the reader unit 400. A pattern image having 22 tone levels is formed on the sheet 110 for each screen and for each color.

On the other hand, in the case of the first calibration, since a pattern image is formed on the sheet 110, sheets 110 may be consumed. Therefore, the image forming apparatus 100 is able to perform the second calibration to correct the tone correction table without consuming sheets 110.

The second calibration is control in which the image forming apparatus 100 causes the printing unit 101 to form a measurement image P on the intermediate transfer belt 106 and generates an image forming condition based on a result of measurement of the measurement image P performed by the sensors 117. The image forming apparatus 100 in the present exemplary embodiment forms a measurement image Pa processed based on the 190 Dot screen, a measurement image Pb processed based on the 230 Dot screen, and a measurement image Pc processed based on the copier screen.

The measurement image Pa in the present exemplary embodiment includes five measurement images having respective different tones. The measurement image Pb in the present exemplary embodiment also includes five measurement images having respective different tones. Image signal values of measurement image data used for forming the measurement image Pa are assumed to be, for example, 20%, 40%, 60%, 80%, and 100% (maximum density). The same also applies to image signal values of measurement image data used for forming the measurement image Pb. Furthermore, the image signal value of measurement image data used for forming the measurement image Pc is assumed to be, for example, 40%.

Moreover, the image forming apparatus 100 in the present exemplary embodiment updates an image forming condition by performing the second calibration even during a period in which the printing unit 101 is continuously forming a plurality of images. In a case where the image forming apparatus 100 is continuously forming a plurality of images, each measurement image P is formed for each color in a space between an image and a subsequent image (an inter-sheet region) in the conveyance direction of the intermediate transfer belt 106. This aims at improving the productivity of the image forming apparatus 100 by narrowing an interval between an image and a subsequent image.

Furthermore, the image forming apparatus 100 in the present exemplary embodiment does not update the γ LUT for the 190 Dot screen before the measurement results (sensor outputs) corresponding to measurement images Pa for five tones are acquired. Similarly, the image forming apparatus 100 in the present exemplary embodiment does not update the γ LUT for the 230 Dot screen before the measurement results (sensor outputs) corresponding to measurement images Pb for five tones are acquired.

Here, if the image forming condition is significantly changed during a period in which images are continuously being formed, the density of an image formed after the image forming condition is changed may become different from the density of an image formed before the image forming condition is changed. Therefore, the image forming apparatus 100 in the present exemplary embodiment restricts the amount of correction of the image forming condition in such a manner that the density of an output image gradually converges on a target density. For example, the image forming apparatus 100 determines an image forming condition by multiplying a difference between the density of the measurement image P and the target density by a coefficient. However, even if the image forming condition is updated based on one coefficient, in a case where a plurality of images continues being formed on a plurality of long sheets, the density of an output image may not converge on the target density.

Figure 5A:
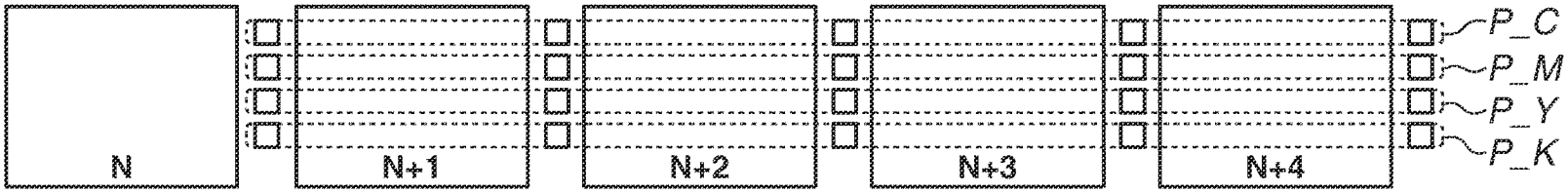
FIGS. 5A and 5B are diagrams illustrating measurement images.

FIG. 5A is a schematic diagram of measurement images P which are formed on the intermediate transfer belt 106 in a case where the image forming apparatus 100 continuously forms images on sheets of paper the length of which in the longitudinal direction thereof is 420 mm (non-long sheets). The measurement image P_C is a cyan measurement image, the measurement image P_M is a magenta measurement image, the measurement image P_Y is a yellow measurement image, and the measurement image P_K is a black measurement image. As illustrated in FIG. 5A, while the printing unit 101 is continuously forming images on five sheets (the N-th sheet to the (N+4)-th sheet), an image and measurement images P are alternately formed on the intermediate transfer belt 106.

Figure 5B:
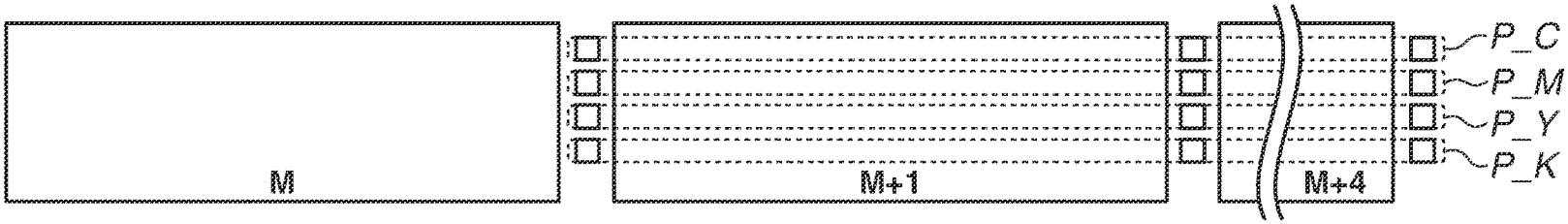

FIG. 5B is a schematic diagram of measurement images P which are formed on the intermediate transfer belt 106 in a case where the image forming apparatus 100 continuously forms images on sheets of paper the length of which in the longitudinal direction thereof is 1000 mm (long sheets). The measurement image P_C is a cyan measurement image, the measurement image P_M is a magenta measurement image, the measurement image P_Y is a yellow measurement image, and the measurement image P_K is a black measurement image. As illustrated in FIG. 5B, while the printing unit 101 is continuously forming images on five sheets (the M-th sheet to the (M+4)-th sheet), an image and measurement images P are alternately formed on the intermediate transfer belt 106.

As illustrated in FIGS. 5A and 5B, the image forming apparatus 100 does not update the tone correction table before completing acquiring results of measurement of measurement images for five tones. Therefore, in a case where images continue being formed on long-sheets, the amount of variation in the density of output images may exceed the capability of converging the density of an output image on a target density. In other words, in a case where images continue being formed on long sheets, even if the image forming apparatus 100 updates the image forming condition, the density of an output image may gradually deviate from the target density.

Thus, when continuously forming images on a plurality of long sheets, the image forming apparatus 100 increases the amount of correction of the image forming condition in such a manner that the density of an output image converges on a target density. The image forming apparatus 100 in the present exemplary embodiment switches between a plurality of adjustment conditions according to the size of a sheet on which to form an image. More specifically, when continuously forming images on a plurality of non-long sheets, the image forming apparatus 100 generates an image forming condition using a first coefficient. On the other hand, when continuously forming images on a plurality of long sheets, the image forming apparatus 100 generates an image forming condition using a second coefficient. At this time, the absolute value of the coefficient for the long sheet is greater than the absolute value of the coefficient for the non-long sheet. Coefficients (feedback rates) and other parameters in the present exemplary embodiment are shown in Table 1.

TABLE 1

| 190 Dot, 230 Dot | Non-long sheet | Long sheet |
|---|---|---|
| Measurement image data signal value | 20%, 40%, 60%, 80%, 100% | 20%, 40%, 60%, 80%, 100% |
| Feedback rate | 40% | 60% |
| LPW adjustment amount | −1, 0, +1 | −2, −1, 0, +1, +2 |
| LPW adjustment threshold value | D5 ≤ D5tgt − 30<br>D5 ≥ D5tgt + 30 | D5 ≤ D5tgt − 60<br>D5 ≥ D5tgt + 60<br>5 ≤ D5tgt − 30<br>D5 ≥ D5tgt + 30 |

Here, the feedback rate (hereinafter also referred to as an "FB rate") represents the rate of having correction for a difference ΔD between the density of a measurement image and a target density. The feedback rate (coefficient) corresponds to a feedback condition. In the case of non-long sheets, the tone correction table is generated in such a manner that 40% of the difference ΔD between the density of a measurement image and a target density is corrected. Moreover, in the case of long sheets, the tone correction table is generated in such a manner that 60% of the difference ΔD between the density of a measurement image and a target density is corrected.

In a case where the image forming apparatus 100 continuously performs image formation on a plurality of long sheets, the execution timing of update processing of the tone correction table would become delayed. Therefore, in a case where the image forming apparatus 100 continuously performs image formation on a plurality of long sheets, the variation in the density of an output image may be unable to be restricted to within an allowable range. Thus, to converge a variation in density caused while the image forming apparatus 100 is continuously performing image formation on a plurality of long sheets, the image forming apparatus 100 in the present exemplary embodiment increases the feedback rate when continuously forming images on a plurality of long sheets.

More specifically, the feedback rate which is used in a period during which images are continuously formed on a plurality of long sheets is higher than the feedback rate which is used in a period during which images are continuously formed on a plurality of non-long sheets. This converges a variation in density caused when the image forming apparatus 100 is continuously performing image formation on a plurality of long sheets, thus preventing the variation in density from exceeding the allowable range.

Figure 9A:
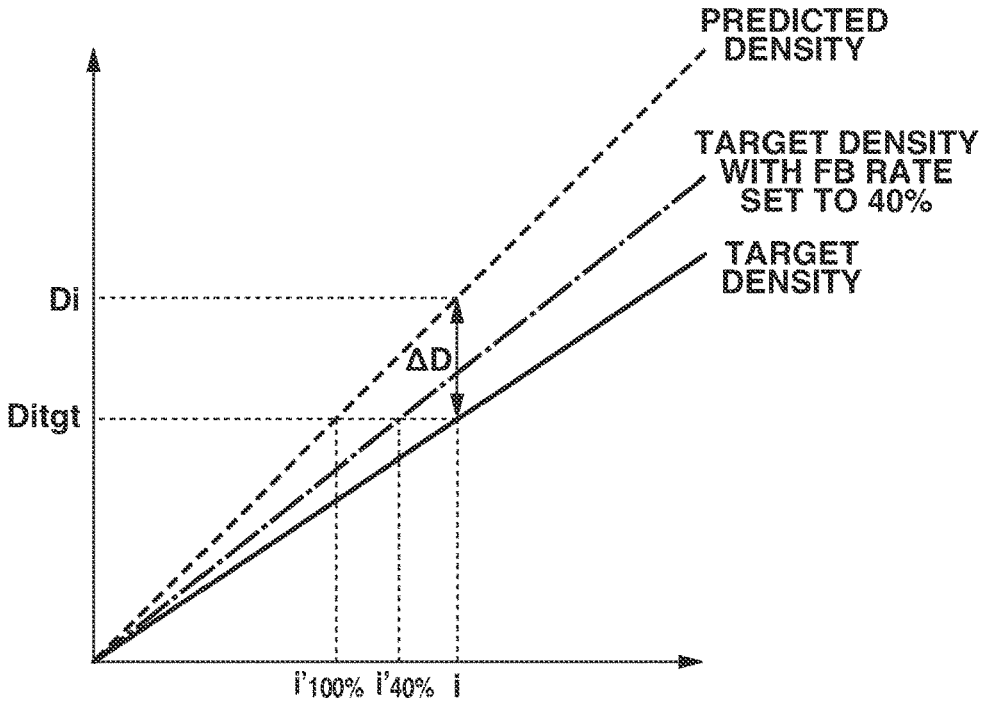
FIGS. 9A and 9B are explanatory diagrams illustrating a method for correcting tone characteristics.
Figure 9B:
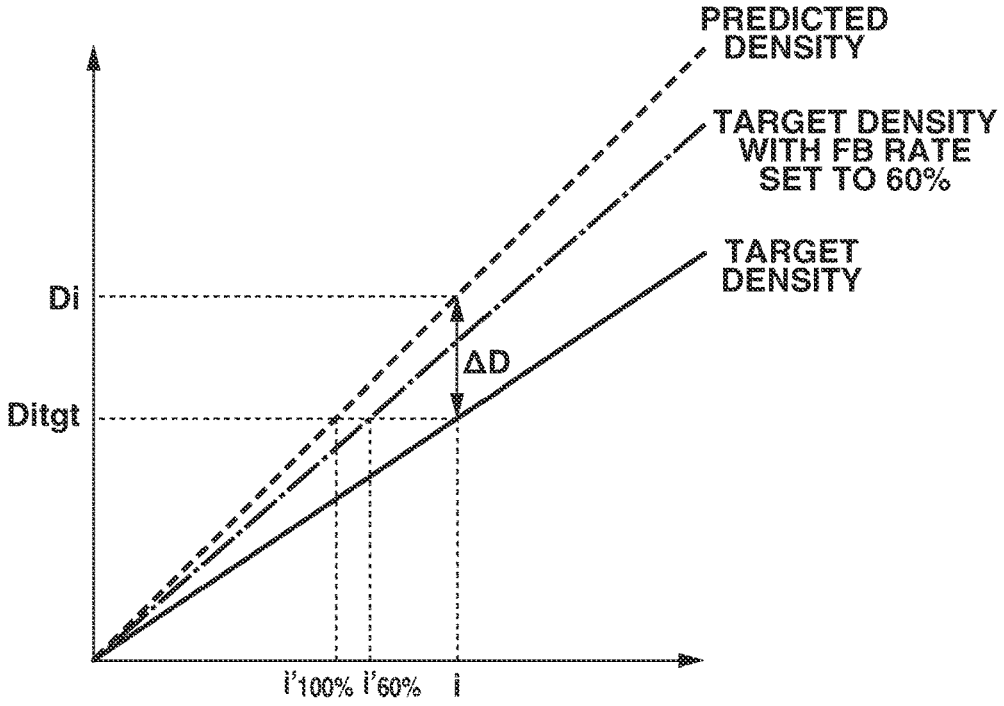

Here, FIGS. 9A and 9B are diagrams used to explain concepts in which the γ LUT generation unit 307 generates a tone correction table. The horizontal axis indicates an image signal value, and the vertical axis indicates the density. A solid line indicates an ideal tone characteristic representing a correspondence relationship between an image signal and a target density. A dashed line indicates a tone characteristic of the printing unit 101 calculated by linear interpolation from the densities of measurement images P measured by the sensors 117. In a case where the feedback rate is 100%, to convert the density Di of an image signal value i into a target density Ditgt, the image signal value i only needs to be converted into an image signal value i'100% corresponding to the target density Ditgt of the image signal value i.

FIG. 9A is a diagram used to explain a concept in which the γ LUT generation unit 307 generates a tone correction table in a case where the feedback rate is 40%. A dashed-dotted line is equivalent to a target density displaced with the feedback rate set to 40%. The γ LUT generation unit 307 displaces a target density by 40% of the difference ΔD between the predicted density and the target density and generates such a tone correction table that the image signal value i is converted into an image signal value i'40% corresponding to the target density Ditgt. In other words, the γ LUT generation unit 307 displaces the target density based on a value obtained by multiplying the density difference ΔD by 0.4 (a first coefficient) and generates a tone correction table based on the displaced target density and the predicted density.

FIG. 9B is a diagram used to explain a concept in which the γ LUT generation unit 307 generates a tone correction table in a case where the feedback rate is 60%. A dashed-dotted line is equivalent to a target density displaced with the feedback rate set to 60%. The γ LUT generation unit 307 displaces a target density by 60% of the difference ΔD between the predicted density and the target density and generates such a tone correction table that the image signal value i is converted into an image signal value i'60% corresponding to the target density Ditgt. In other words, the γ LUT generation unit 307 displaces the target density based on a value obtained by multiplying the density difference ΔD by 0.6 (a second coefficient) and generates a tone correction table based on the displaced target density and the predicted density.

The difference in feedback rate is a difference in a coefficient used to generate a tone correction table. The first coefficient corresponding to the feedback rate 40% is 0.4, and the second coefficient corresponding to the feedback rate 60% is 0.6. If the feedback rate differs, the amount of correction in a case where the difference between the target density and the predicted density is a predetermined value differs. The amount of correction corresponding to the feedback rate 60% is larger than the amount of correction corresponding to the feedback rate 40%.

Moreover, the image forming apparatus 100 adjusts laser power (LPW) serving as an image forming condition based on a difference between a result of measurement of any one measurement image included in a plurality of measurement images P and a target measurement result. The image forming apparatus 100 in the present exemplary embodiment controls LPW based on a difference between the density D5 of a measurement image Pb100 with an image signal value 100% formed with use of the 230 Dot screen and the target density. The image forming apparatus 100 decreases LPW if the density D5 of the specific measurement image Pb100 is higher than the target density and increases LPW if the density D5 of the specific measurement image Pb100 is lower than the target density. Furthermore, the timing at which the image forming apparatus 100 changes LPW is assumed to be after the amount of LPW adjustment is determined and timing at which any leading measurement image of the measurement images Pa, Pb, and Pc is formed.

Moreover, the image forming apparatus 100 in the present exemplary embodiment increases the amount of adjustment of LPW in the case of continuously forming images on a plurality of long sheets. Regardless of a long sheet or a non-long sheet, the image forming apparatus 100 changes LPW by one level if the difference between the density D5 of the specific measurement image Pb100 and the target density is greater than a first predetermined value. Moreover, in a case where the image forming apparatus 100 continuously forms images on a plurality of long sheets, the image forming apparatus 100 changes LPW by two levels if the difference between the density D5 of the specific measurement image Pb100 and the target density is greater than a second predetermined value. Here, the absolute value of the second predetermined value is greater than the absolute value of the first predetermined value.

<Image Forming Processing>

Next, the second calibration, which the CPU 300 performs while the image forming apparatus 100 is continuously forming images, is described with reference to the flowchart of FIG. 6 and the table of FIG. 8. The CPU 300 starts an image forming operation when image data for copying corresponding to an original has been input from the reader unit 400 or when image data for printing transferred via the I/F unit 302 has been input.

First, in step S001, the CPU 300 determines whether the sheet on which an image is to be formed is a long sheet 501. For example, the CPU 300 acquires information about the size of a sheet designated by the user via the operation unit 180, and determines whether the long sheet 501 has been designated based on the acquired information. If an image is to be formed on the long sheet 501 (YES in step S001), then in step S002, the CPU 300 sets the feedback rate to 60% and then advances the processing to step S004. On the other hand, if an image is to be formed on the non-long sheet (sheet 110) (NO in step S001), then in step S003, the CPU 300 sets the feedback rate to 40% and then advances the processing to step S004.

In step S004, the CPU 300 determines whether it is necessary to change LPW. The CPU 300 determines whether it is necessary to change LPW based on a result of LPW determination processing last performed. In other words, in a case where the amount of adjustment of LPW has been set, the CPU 300 determines that it is necessary to change LPW.

Moreover, the image forming apparatus 100 in the present exemplary embodiment determines that LPW is changeable at timing when a measurement image Pa with an image signal value 20% is formed or at timing when a measurement image Pb with an image signal value 20% is formed. This is because, if LPW is changed, the density of a measurement image would also change. Therefore, at timing when an image corresponding to the L-th sheet is formed or at timing when an image corresponding to the (L+5)-th sheet is formed, the CPU 300 changes LPW in a case where the amount of adjustment of LPW has been determined.

If it is necessary to change LPW (YES in step S004) and at timing when LPW is changeable, then in step S005, the CPU 300 changes LPW based on the amount of adjustment. Then, in step S006, the CPU 300 controls the printing unit 101 to form an image based on image data, and, in step S007, the CPU 300 controls the printing unit 101 to form a measurement image P based on measurement image data. In step S008, the CPU 300 controls the sensors 117 to measure the measurement image P at timing when the measurement image P arrives at the measurement position of the sensors 117.

The image forming apparatus 100 in the present exemplary embodiment forms one measurement image P for each color each time an image for one page is formed. Therefore, the CPU 300 selects one image signal value for forming the measurement image P in step S007 from among image signal values (20%, 40%, 60%, 80%, and 100%) illustrated in FIG. 8. Moreover, the CPU 300 selects one screen for forming the measurement image P in step S007 from among the 190 Dot screen, the 230 Dot screen, and the copier screen illustrated in FIGS. 4A to 4C.

Then, in step S007, the CPU 300 causes the pattern generator 305 to output measurement image data with the selected image signal value and causes the tone correction unit 316 to correct the measurement image data based on a tone correction table corresponding to the selected screen. Then, the CPU 300 causes the halftone processing unit 317 to perform conversion of image data based on the selected screen and controls the printing unit 101 to form a measurement image P on the intermediate transfer belt 106.

Next, in step S009, the CPU 300 determines whether the printing unit 101 has completed forming all of the images that are based on the image data. If the printing unit 101 has completed forming all of the images (YES in step S009), the CPU 300 ends processing for the second calibration.

On the other hand, if the printing unit 101 has not yet completed forming all of the images (NO in step S009), the CPU 300 advances the processing to step S010. Then, in step S010, the CPU 300 determines whether the CPU 300 has completed acquiring results of measurement of a number of measurement images P previously determined for each screen. If the CPU 300 has not yet completed acquiring results of measurement of a number of measurement images P previously determined for each screen (NO in step S010), the CPU 300 returns the processing to step S006. With this, the CPU 300 does not update an image forming condition before the CPU 300 completes acquiring results of measurement of a number of measurement images P previously determined for each screen. Furthermore, measured data (density) about the measurement image P is stored in the RAM 309.

On the other hand, if the CPU 300 has completed acquiring results of measurement of a number of measurement images P previously determined for each screen (YES in step S010), then in step S011, the CPU 300 performs LPW determination processing (FIG. 7), and then advances the processing to step S012. In step S012, the γ LUT generation unit 307 generates a tone correction table (γ LUT) corresponding to a screen and a color of the measurement image P based on the density of the measurement image P, the target density, and the feedback rate (coefficient). Then, the CPU 300 returns the processing to step S001.

Here, in a case where the measured data has been acquired while images are being formed on five long sheets 501, the feedback rate (coefficient) which is used to generate a tone correction table in step S012 is set to 60% (0.6). For example, in a case where the image forming apparatus 100 forms images on the L-th sheet to the (L+4)-th sheet all of which are long sheets 501, the feedback rate (coefficient) which the γ LUT generation unit 307 uses is 60% (0.6). For example, in a case where the image forming apparatus 100 forms images on the (L+5)-th sheet to the (L+8)-th sheet which are long sheets 501 and forms an image on the (L+9)-th sheet which is a sheet 110, the feedback rate (coefficient) which the γ LUT generation unit 307 uses is 40% (0.4). The image forming apparatus 100 in the present exemplary embodiment changes the feedback rate (coefficient) from 40% (0.4) to 60% (0.6) in the case of continuously forming images on a predetermined number of long sheets 501.

Figure 6:
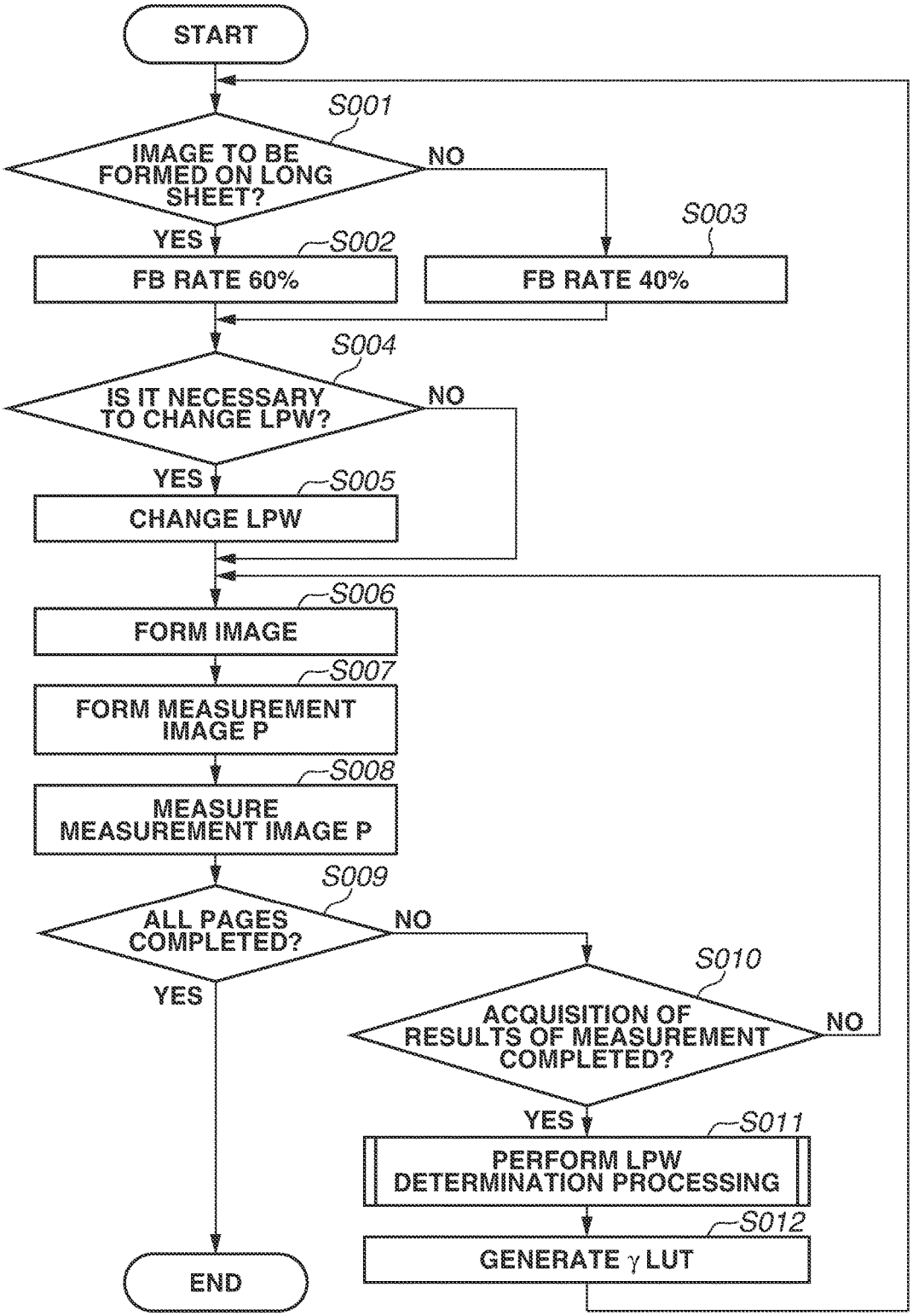
FIG. 6 is a flowchart of an image forming operation.
Figure 7:
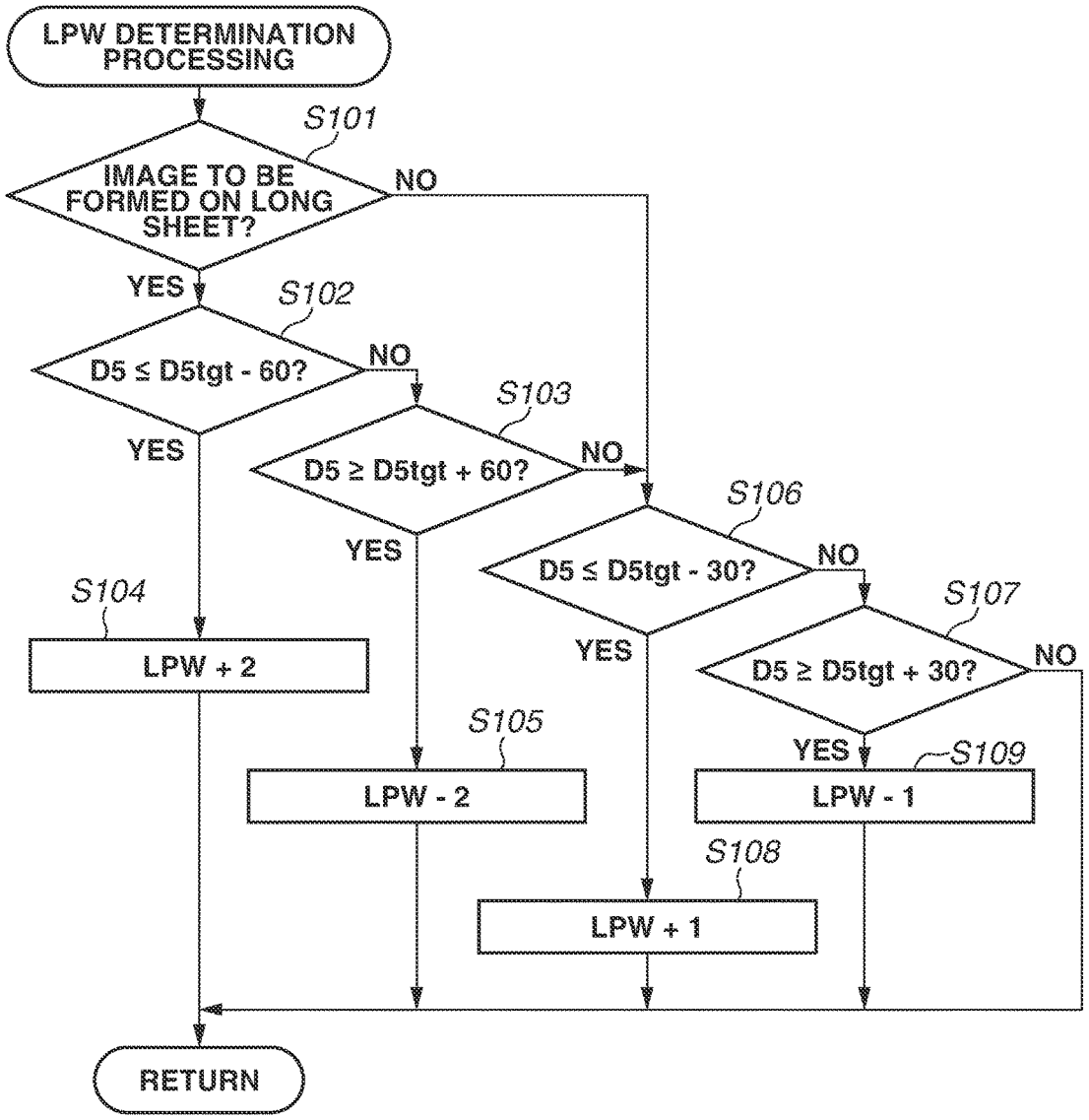
FIG. 7 is a flowchart concerning laser power (LPW) determination processing.

Next, the LPW determination processing performed in step S011 illustrated in FIG. 6 is described with reference to the flowchart of FIG. 7. The image forming apparatus 100 determines whether it is necessary to change LPW based on a difference between the density D5 of the specific measurement image Pb100 and the target density D5*tgt*. Moreover, the image forming apparatus 100 determines the amount of adjustment of LPW based on the difference between the density D5 and the target density D5*tgt*. Furthermore, in the following description, it is supposed that the smaller the numerical value of the density D5, the lower the density of the measurement image is, and, the larger the numerical value of the density D5, the higher the density of the measurement image is.

First, in step S101, the CPU 300 determines whether images continuously formed in a period in which a previously-determined number of measurement images P have been formed (hereinafter referred to as a "test period") are images all of which are formed on long sheets 501. In the image forming apparatus 100 in the present exemplary embodiment, in a case where images continuously formed in the test period are images which are formed on five long sheets 501, a variation in density may increase during a period in which images are being formed on a plurality of long sheets 501. Therefore, when updating a tone correction table (γ LUT) during a period in which images are continuously formed on five long sheets 501, the image forming apparatus 100 in the present exemplary embodiment changes the amount of adjustment of LPW as well as the feedback rate (coefficient).

If images continuously formed in the test period are images all of which are formed on long sheets 501 (YES in step S101), the CPU 300 advances the processing to step S102. Then, in step S102, the CPU 300 determines whether the density D5 of the measurement image Pb100 is equal to or lower than a lower limit value (=D5*tgt*−60). If the density D5 is equal to or lower than the lower limit value (=D5*tgt*−

60) (YES in step S102), then in step S104, the CPU 300 increases LPW by two levels.

Then, the CPU 300 determines that it is necessary to change LPW and ends the LPW determination processing. Here, in a case where LPW increases by two levels, since the intensity of laser light which the exposure device 103 emits increases, the density of an image formed on the photosensitive drum 105 increases.

On the other hand, if the density D5 of the measurement image Pb100 is higher than the lower limit value (=D5*tgt*−60) (NO in step S102), the CPU 300 advances the processing to step S103. In step S103, the CPU 300 determines whether the density D5 of the measurement image Pb100 is equal to or higher than an upper limit value (=D5*tgt*+60). If the density D5 is equal to or higher than the upper limit value (=D5*tgt*+60) (YES in step S103), then in step S105, the CPU 300 decreases LPW by two levels.

Then, the CPU 300 determines that it is necessary to change LPW and ends the LPW determination processing. Here, in a case where LPW decreases by two levels, since the intensity of laser light which the exposure device 103 emits decreases, the density of an image formed on the photosensitive drum 105 decreases.

Moreover, if the density D5 of the measurement image Pb100 is lower than the upper limit value (=D5*tgt*+60) (NO in step S103), the CPU 300 advances the processing to step S106. In step S106, the CPU 300 determines whether the density D5 of the measurement image Pb100 is equal to or lower than a low density threshold value (=D5*tgt*−30). If the density D5 is equal to or lower than the low density threshold value (=D5*tgt*−30) (YES in step S106), then in step S108, the CPU 300 increases LPW by one level.

Then, the CPU 300 determines that it is necessary to change LPW and ends the LPW determination processing. Here, in a case where LPW increases by one level, since the intensity of laser light which the exposure device 103 emits increases, the density of an image formed on the photosensitive drum 105 increases. Furthermore, as the level of LPW is larger, the amount of change also increases.

On the other hand, if the density D5 of the measurement image Pb100 is higher than the low density threshold value (=D5*tgt*−30) (NO in step S106), the CPU 300 advances the processing to step S107. In step S107, the CPU 300 determines whether the density D5 of the measurement image Pb100 is equal to or higher than a high density threshold value (=D5*tgt*+30). If the density D5 is equal to or higher than the high density threshold value (=D5*tgt*+30) (YES in step S107), then in step S109, the CPU 300 decreases LPW by one level.

Then, the CPU 300 determines that it is necessary to change LPW and ends the LPW determination processing. In a case where LPW decreases by one levels since the intensity of laser light which the exposure device 103 emits decreases, the density of an image formed on the photosensitive drum 105 decreases.

Moreover, if the density D5 of the measurement image Pb100 is lower than the high density threshold value (=D5*tgt*+30) (NO in step S107), the CPU 300 determines that it is unnecessary to change LPW and ends the LPW determination processing. In this case, in step S004 (FIG. 6) of the second calibration, the CPU 300 determines that it is not necessary to change LPW. Thus, LPW is not changed.

Moreover, if images continuously formed in the test period are not images all of which are formed on long sheets 501 (NO in step S101), the CPU 300 advances the processing to step S106. Processing in step S106 and subsequent steps has been described above, and is, therefore, omitted from description here. With this, in a case where images continuously formed in the test period are not images all of which are formed on long sheets 501, the CPU 300 determines that the adjustment range of LPW is ±1 level. This is smaller than the adjustment range of LPW (±2 levels) determined in a case where images continuously formed in the test period are images all of which are formed on long sheets 501.

The image forming apparatus 100 according to the present exemplary embodiment is able to adjust LPW in such a manner that the density of an output image converges on a target density even when images are continuously formed on long sheets 501.

Moreover, the image forming apparatus 100 in the present exemplary embodiment changes both the feedback rate (coefficient) and the adjustment range of LPW, but can be configured to change any one of these. If any one of the feedback rate (coefficient) and the adjustment range of LPW can be changed, the density of an output image can be prevented from greatly deviating from the target density.

<Formation Sequence of Measurement Image P>

The explanation and use application of various screens and the error diffusion method are described as follows. The 190 Dot screen is used when a photographic image or graphic image is printed. The 190 Dot screen is frequently used, and is also used for a portrait photograph, in which color reproduction is significant.

The 230 Dot screen is used when a character image is printed. The 230 Dot screen is greater in the number of lines per inch than the 190 Dot screen, and makes jaggies of a halftone character inconspicuous. The density of a character image is often consciously designated by the user.

The copier screen is used when an image other than character images among images for copying is printed. The images for copying are lower in tone characteristic, resolution, and granularity than images for printing.

The error diffusion method is used for a map mode or when a character image among images for copying is printed. Moreover, the error diffusion method is used in a case where it is designated by the user when an image for printing is printed. The error diffusion method is suited for printing a high-resolution image. The error diffusion method makes moire unlikely to occur in an image.

The image forming apparatus 100 forms measurement images Pa and Pb corresponding to the 190 Dot screen and the 230 Dot screen, a variation of the hue of which the user intends to prevent or reduce, each for five tones. This enables correcting the tone characteristics of graphic images or photographic images over a wide range and with a high degree of accuracy. Moreover, the image forming apparatus 100 forms a measurement image P corresponding to the copier screen for only one tone.

Since a measurement image P corresponding to the copier screen is formed for only one tone, the γ LUT generation unit 307 calculates tone characteristics from the density of a measurement image P for one tone based on a previously stored model formula, thus generating a tone correction table for the copier screen. Furthermore, since the number of tones of the 190 Dot screen or the 230 Dot screen used for print images is less than the number of tones of a measurement image P corresponding to the copier screen, the tone characteristics can be corrected more accurately in print images than in copy images.

FIG. 8 is a table showing screens of measurement images P which are formed in tone correction and image signal values. During a period in which images for twelve pages are being formed, five measurement images Pa corresponding to the 190 Dot screen, five measurement images Pb corresponding to the 190 Dot screen, and one measurement image Pc corresponding to the copier screen, i.e., eleven measurement images P in total, are formed. The γ LUT generation unit 307 repeatedly forms eleven measurement images P. The image forming apparatus 100 updates a tone correction table (γ LUT) corresponding to each screen each time images for eleven pages are formed.

The number of tones of the copier screen, which is used to form copy images, is set less than that of the 190 Dot screen or 230 Dot screen, which is used to form print images. This enables correcting a tone correction table used for forming print images in a wide range from a low density to a high density with a high degree of accuracy. Moreover, since the tone correction table used for forming print images can be updated with a high degree of accuracy, even in a case where the density of an image changes rapidly, the density of a print image can be stabilized.

Furthermore, while, in the above-described configuration, four sensors 117 are provided at a position at which to measure measurement images formed on the intermediate transfer belt 106, the sensor 117 can be configured to be provided at a position at which to measure a measurement image formed on each photosensitive drum 105. For example, in a case where the color of the intermediate transfer belt 106 is black so that the accuracy of measurement of a measurement image for black is low, a configuration in which the measurement image for black is measured by the sensor 117 provided for the photosensitive drum 105 for black can be employed.

Moreover, the image forming apparatus 100 can be configured such that a measurement image for black is measured by the sensor 117 provided for the photosensitive drum 105 for black and measurement images for cyan, magenta, and yellow are measured by the sensors 117 provided for the intermediate transfer belt 106. The sensor 117 provided for the photosensitive drum 105 for black functions as a first measurement unit configured to measure a first measurement image on a first photosensitive member, and the sensors 117 provided for the intermediate transfer belt 106 function as a second measurement unit configured to measure a second measurement image on an image bearing member.

According to an exemplary embodiment of the disclosure, even in a case where images are continuously formed on a plurality of long sheets, since adjustment processing for an image forming condition suited for the long sheet 501 is performed, a variation in the density of an output image can be prevented or reduced.

While the present disclosure has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-109253 filed Jun. 1, 2017, which is hereby incorporated by reference herein in its entirety.

What is claimed is:

1. An image forming apparatus comprising:

a conveyance roller configured to convey a sheet;

an image forming unit configured to form an image on an image bearing member;

a transfer portion at which the image is transferred from the image bearing member to the sheet;

a sensor configured to measure a measurement image formed on the image bearing member; and a controller configured to:

in a case where the image forming unit forms images on a plurality of first sheets, control the image forming unit to form a first measurement image between an image which is to be transferred to a first sheet of the plurality of first sheets and an image which is to be transferred to a different first sheet of the plurality of first sheets, control the sensor to measure the first measurement image, and control an image forming condition based on a measurement result of the first measurement image measured by the sensor and a first feedback condition, and, in a case where the image forming unit forms images on a plurality of second sheets, control the image forming unit to form a second measurement image between an image which is to be transferred to a second sheet of the plurality of second sheets and an image which is to be transferred to a different second sheet of the plurality of second sheets, control the sensor to measure the second measurement image, and control the image forming condition based on a measurement result of the second measurement image measured by the sensor and a second feedback condition which is different from the first feedback condition, wherein a length of the second sheet in a conveyance direction is larger than a length of the first sheet in the conveyance direction.

2. The image forming apparatus according to claim 1, wherein an amount of correction of the image forming condition determined based on the measurement result of the second measurement image and the second feedback condition in a case where a difference between the measurement result of the second measurement image and a target measurement result is a predetermined difference is larger than an amount of correction of the image forming condition determined based on the measurement result of the first measurement image and the first feedback condition in a case where a difference between the measurement result of the first measurement image and the target measurement result is the predetermined difference.

3. The image forming apparatus according to claim 1, wherein the first feedback condition is a first coefficient that is used to determine an amount of correction of the image forming condition, wherein the second feedback condition is a second coefficient that is used to determine an amount of correction of the image forming condition, and wherein an absolute value of the second coefficient is larger than an absolute value of the first coefficient.

4. The image forming apparatus according to claim 1, further comprising an image processing unit configured to perform image processing for executing conversion of image data based on a conversion condition, wherein the image forming unit forms the image based on the converted image data, and wherein the image forming condition includes the conversion condition.

5. The image forming apparatus according to claim 4, wherein the conversion condition is equivalent to a tone correction table that is used to correct a tone characteristic of an image which is to be formed by the image forming unit.

6. The image forming apparatus according to claim 1, wherein the controller further:

controls the image forming unit to form a different first measurement image between an image which is to be transferred to the different first sheet of the plurality of first sheets and an image which is to be transferred to a further different first sheet of the plurality of first sheets, controls the image forming condition based on the measurement result of the first measurement image and a measurement result of the different first measurement image measured by the sensor and the first feedback condition, controls the image forming unit to form a different second measurement image between an image which is to be transferred to the different second sheet of the plurality of second sheets and an image which is to be transferred to a further different second sheet of the plurality of second sheets, and controls the image forming condition based on the measurement result of the second measurement image and a measurement result of the different second measurement image measured by the sensor and the second feedback condition.

7. The image forming apparatus according to claim 1, wherein the length of the first sheet in the conveyance direction is shorter than a predetermined length, and wherein the length of the second sheet in the conveyance direction is longer than the predetermined length.

8. The image forming apparatus according to claim 1, wherein the sensor includes a light emitting portion and a light receiving portion, and wherein the sensor measures reflected light from the measurement image.

9. An image forming apparatus comprising:

an image processor configured to convert image data based on a conversion condition;

a conveyance roller configured to convey a sheet;

an image forming unit configured to form an image on an image bearing member based on the image data converted by the image processor;

a transfer portion at which the image is transferred from the image bearing member to the sheet;

a sensor configured to measure a measurement image formed on the image bearing member; and a controller configured to:

generate the conversion condition based on the measurement result of the measurement image measured by the sensor and a first feedback condition in a case where, while a plurality of images transferred to a plurality of sheets in a first type is formed, the measurement image is formed between an image to be transferred to a first sheet that is within the plurality of the sheets in the first type, and an image to be transferred to a second sheet that follows the first sheet; and generate the conversion condition based on the measurement result of the measurement image measured by the sensor and a second feedback condition that is different from the first feedback condition in a case where, while a plurality of other images transferred to a plurality of sheets in a second type is formed, the measurement image is formed between an image to be transferred to a third sheet that is within the plurality of the sheets in the second type, and an image to be transferred to a fourth sheet that follows the third sheet;

wherein a length of the plurality of sheets in the first type in the conveyance direction by the conveyance roller is shorter than the predetermined length, and wherein the length of the plurality of sheets in the second type in the conveyance direction by the conveyance roller is longer than the predetermined length.

10. The image forming apparatus according to claim 9, wherein the conversion condition includes a tone correction condition utilized for correcting a tone characteristic of the image formed by the image forming unit.

11. The image forming apparatus according to claim 9, wherein the first feedback condition is a first correction coefficient, wherein the second feedback condition is a second correction coefficient, and wherein the absolute value of the second correction coefficient is greater than the absolute value of the first correction coefficient.

12. The image forming apparatus according to claim 9, wherein the controller controls the image forming unit to form the measurement image every time when a predetermined number of images are formed by the image forming unit.

* * * * *